US008813768B2

(12) United States Patent
Lee

(10) Patent No.: US 8,813,768 B2
(45) Date of Patent: Aug. 26, 2014

(54) TENT POLE

(75) Inventor: Yoon Bok Lee, Gyeonggi-do (KR)

(73) Assignee: Yonan Aluminum Co., Ltd., Kyungki-do (KR)

( * ) Notice: Subject to any disclaimer, the term of this patent is extended or adjusted under 35 U.S.C. 154(b) by 118 days.

(21) Appl. No.: 13/266,302

(22) PCT Filed: Sep. 15, 2010

(86) PCT No.: PCT/KR2010/006320

§ 371 (c)(1),
(2), (4) Date: Oct. 26, 2011

(87) PCT Pub. No.: WO2011/034344

PCT Pub. Date: Mar. 24, 2011

(65) Prior Publication Data

US 2012/0167935 A1 Jul. 5, 2012

(30) Foreign Application Priority Data

Sep. 15, 2009 (KR) ..... 10-2009-0086755
May 7, 2010 (KR) ..... 10-2010-0043169

(51) Int. Cl.
*E04H 15/60* (2006.01)
*E04H 15/34* (2006.01)
*E04H 15/32* (2006.01)

(52) U.S. Cl.
CPC ..... *E04H 15/60* (2013.01); *E04H 2015/326* (2013.01)
USPC ..... 135/114; 135/123; 135/127; 403/308

(58) Field of Classification Search
CPC ..... E04H 15/32
USPC ..... 135/114, 123, 120.3–120.4, 143–144, 135/74; 403/300, 308, 314, 372, 292; 43/6, 43/12, 18.1 R, 18.1 CT, 18.1 HR; 248/528, 248/533, 150, 155.4, 188.6, 188.8, 308; 294/175, 170; 81/177.1, 487
See application file for complete search history.

(56) References Cited

U.S. PATENT DOCUMENTS 3,947,141 A * 3/1976 Casset ..... 403/109.8
4,063,830 A * 12/1977 Ban ..... 403/3

(Continued)

FOREIGN PATENT DOCUMENTS

JP 7004121 A 1/1995
JP 11141193 A 5/1999

(Continued)

OTHER PUBLICATIONS

Search Report for PCT/KR2010/006320 dated Jun. 28, 2011, 3 pages.

*Primary Examiner* — Winnie Yip
(74) *Attorney, Agent, or Firm* — Dority & Manning, P.A.

(57) ABSTRACT

Disclosed are a connection member for a tent pole, and a detachable jig of the same. The connection member for a tent pole, which connects unit poles of which opposite end parts are internally formed with insertion holes, the connection member including: a pair of insert members which are respectively fitted in and fixed to insertion holes at end parts of a pair of adjacent unit poles; a connecting pipe body which is formed with a through hole in a middle thereof to be arranged between the insert members and includes opposite end parts respectively inserted the insertion holes of the unit poles; and an elastic cord which includes opposite end parts respectively fixed to the pair of insert members while being inserted in the through hole of the connecting pipe body and provides elasticity so that the end parts of the pair of adjacent unit poles can be in contact with each other.

15 Claims, 14 Drawing Sheets

(56) References Cited

U.S. PATENT DOCUMENTS

| | | | | |
|---|---|---|---|---|
| 4,132,408 | A * | 1/1979 | Sabat | 463/47.5 |
| 4,706,696 | A * | 11/1987 | Gillis | 135/127 |
| 4,795,165 | A * | 1/1989 | Tehan | 473/578 |
| 5,201,598 | A * | 4/1993 | Tehan | 403/372 |
| 6,382,223 | B1 * | 5/2002 | Lah | 135/114 |
| 6,557,572 | B2 * | 5/2003 | Lah | 135/114 |
| 6,678,989 | B1 * | 1/2004 | Lowe | 43/6 |
| 7,722,626 | B2 * | 5/2010 | Middleman et al. | 606/113 |
| 2006/0233599 | A1 * | 10/2006 | Lah | 403/292 |
| 2009/0000434 | A1 * | 1/2009 | Shinma et al. | 81/491 |
| 2011/0303255 | A1 * | 12/2011 | DeLap et al. | 135/114 |

FOREIGN PATENT DOCUMENTS

| | | |
|---|---|---|
| KR | 9754947 U | 10/1997 |
| KR | 200400494 | 11/2005 |

* cited by examiner

TENT POLE

CROSS-REFERENCE TO RELATED APPLICATION

This application is the national stage entry of International Patent Application No. PCT/KR2010/006320 haying a filing date of Sep. 15, 2010, which claims priority to and the benefit of Korean Patent Application No. 10-2009-0086755 filed in the Korean Intellectual Property Office on Sep. 15, 2009 and Korean Patent Application No. 10-2010-0043169 filed in the Korean Intellectual Property Office on May 7, 2010, the entire contents of which are incorporated herein by reference.

BACKGROUND OF THE INVENTION (a) Field of the Invention

The present invention relates to a connection member for a tent pole and a detachable jig for the same, and more particularly to a connection member for a tent pole, which is lightweight since the minimum length of an elastic cord is applied to only end parts of unit poles so as to connect the unit poles, and a detachable jig for the same, in which the connection members for the tent pole can be conveniently and precisely assembled and disassembled.

(b) Description of the Related Art

In general, a tent is equipment used in leisure activities such as mountain climbing, fishing, camping, etc. and includes canvas forming an outer appearance and poles supporting the canvas.

The poles are frames for supporting the canvas as described above. As representative art related to such poles, there is Korean Utility Model Publication No. 20-1988-0006446 (titled "FOLDING DEVICE FOR TENT POLES").

The above related art is characterized in that an inner supporting pipe and an outer supporting pipe are deposited so that inner and outer walls of one-side pole front end part can have a fitting-in groove in the state that an elastic cord is inserted in a pole, in which the inner supporting pipe more protrudes than the outer supporting pipe.

With this configuration, the related art provides convenience since not only the poles are easily folded and effectively decreased in volume when carried about, but also the poles are fitted in the fitting-in groove while being inserted between the inner and outer supporting pipes in order not to fall out when used.

However, an elastic rubber cord is inserted throughout the whole poles to bind the individual poles with each other, and thus the total weight of the poles becomes heavier due to the weight of the elastic rubber cord. Accordingly, the weight of poles causes some trouble when the poles are transported.

Also, if a single rubber cord is used for connecting a plurality of poles as described above, the elasticity of the rubber cord is varied depending on folding positions of the poles when the poles are folded in sequence. Thus, the rubber cord is excessively tensed in a part where the last poles are folded, and therefore the life of the rubber cord is shortened.

Further, the elastic rubber cord has to pass through the inside of the poles so as to connect the plurality of poles, and thus an assembling process thereof is inconvenient.

Furthermore, if the rubber cord connecting the poles is broken while being used, all the plurality of poles constituting one set has to be taken for repairing or a new set of poles connected by the rubber cord has to be purchased again.

SUMMARY OF THE INVENTION

Accordingly, the present invention is conceived to solve the forgoing problems, and an aspect of the present invention is to provide a connection member for a tent pole, which is lightweight since the minimum length of an elastic cord is applied to only end parts of unit poles so as to connect the unit poles.

Another aspect is to provide a connection member for a tent pole, in which if a rubber cord is broken due to repeated use, only the connection member of a corresponding position can be replaced with a new connection member, and thus there is no problem of long repairing time or no exorbitant cost of repair as opposed to a conventional one.

Still another aspect is to provide a connection member for a tent pole, in which a rubber cord connecting two poles is independently arranged in a part where the poles are folded, so that the rubber cord can be tensed having constant elasticity regardless of folding positions, thereby preventing the life of the rubber cord from being shortened as it is excessively tensed at only a certain region like the conventional one.

Still another aspect is to provide a connection member for a tent pole, in which a pair of inserts to which both end parts of a rubber cord are fastened to end parts of a pair of unit poles, so that an assembling process can be simplified without passing the rubber cord through the inside of the unit poles like the conventional one.

Still another aspect is to provide a connection member for a tent pole, in which both end parts of an elastic cord are formed integrally with insert members through insert injection molding, thereby decreasing manufacturing and assembling efforts and enabling production automation.

Still another aspect is to provide a connection member for a tent pole, in which an elastic cord is configured with several rubber cords surrounded by a braided layer, and the braided layer is welded to an insert member while the insert member is molded, thereby preventing the insert member from being separated from the elastic cord.

Still another aspect is to provide a detachable jig of a connection member for a tent pole, in which a pair of insert members are forcibly fitted in opposite unit poles at the same depth and by the same pressure while the insert members of the connection member for the tent pole are forcibly fitted in the opposite unit poles, so that either of the insert members can be prevented from being easily separated due to imbalance of coupling force while disassembling the unit poles.

Still another aspect is to provide a detachable jig of a connection member for a tent pole, in which opposite sides of a body are formed with grips having finger holes, so that a user can be protected from being hit by the insert member while pulling out the insert member from the unit pole.

According to an exemplary embodiment, there is provided a connection member for a tent pole, which connects unit poles of which opposite end parts are internally formed with insertion holes, the connection member including: a pair of insert members which are respectively fitted in and fixed to insertion holes at end parts of a pair of adjacent unit poles; a connecting pipe body which is formed with a through hole in a middle thereof to be arranged between the insert members and includes opposite end parts respectively inserted the insertion holes of the unit poles; and an elastic cord which includes opposite end parts respectively fixed to the pair of insert members while being inserted in the through hole of the connecting pipe body and provides elasticity so that the end parts of the pair of adjacent unit poles can be in contact with each other.

The opposite end parts of the elastic cord may be integrated into the insert member by insert injection molding.

The elastic cord may include a plurality of rubber cords having elasticity, and a braided layer surrounding the outside of the rubber cords, and the braided layer is welded (W) to the inside of the insert members during the injection molding process for the insert member with a synthetic resin.

The unit pole may include an expanded pipe part to receive the connecting pipe body at opposite end parts of a pole body, and an inclined part at an edge between the pole body and the expanded pipe part, and the insert member may include an insertion part fitted in the insertion hole of the unit pole at a front end part thereof, and a tapered part closely adhered to an inside of the inclined part at a rear end part thereof.

The insert member may be formed with an inclined surface for guiding insertion at a front end edge of the insertion part.

One of the pair of insert members may be formed with a fixing part to be inserted in the connecting pipe body at a rear end part thereof, and fixed to the connecting pipe body.

Another aspect may be achieved by providing a detachable jig of assembling the foregoing connection member to a tent pole, the detachable jig including: a body formed with an insertion pin at one end part thereof to be inserted in the insertion hole of the unit pole, and a receiving groove to receive the connecting pipe body at the other end part thereof; a through hole connecting the insertion pin and the receiving groove of the body; and a cut-opened part lengthwise formed at one side of the body and laterally opening the through hole and the receiving groove.

The length of the insertion pin and the depth of the receiving groove may be respectively half of total length of the connecting pipe body.

The body may include a grip at least one side thereof.

The grip may internally include a finger hole.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF THE EMBODIMENTS

Figure 1:
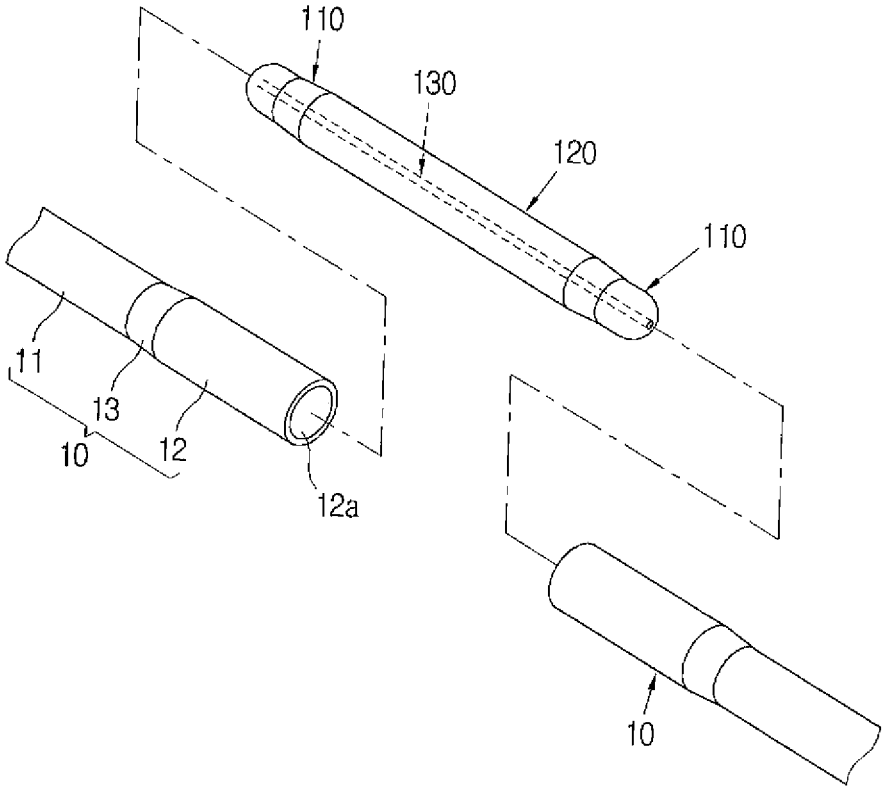
FIG. 1 is a perspective view of a connection member for a tent pole according to an exemplary embodiment.

Prior to description, elements will be representatively explained in a first embodiment and only different configurations will be described in another embodiment, in which like reference numerals refer to like elements throughout the embodiments.

Hereinafter, a connection member for a tent pole according to a first exemplary embodiment will be described with reference to the accompanying drawings.

Figure 2:
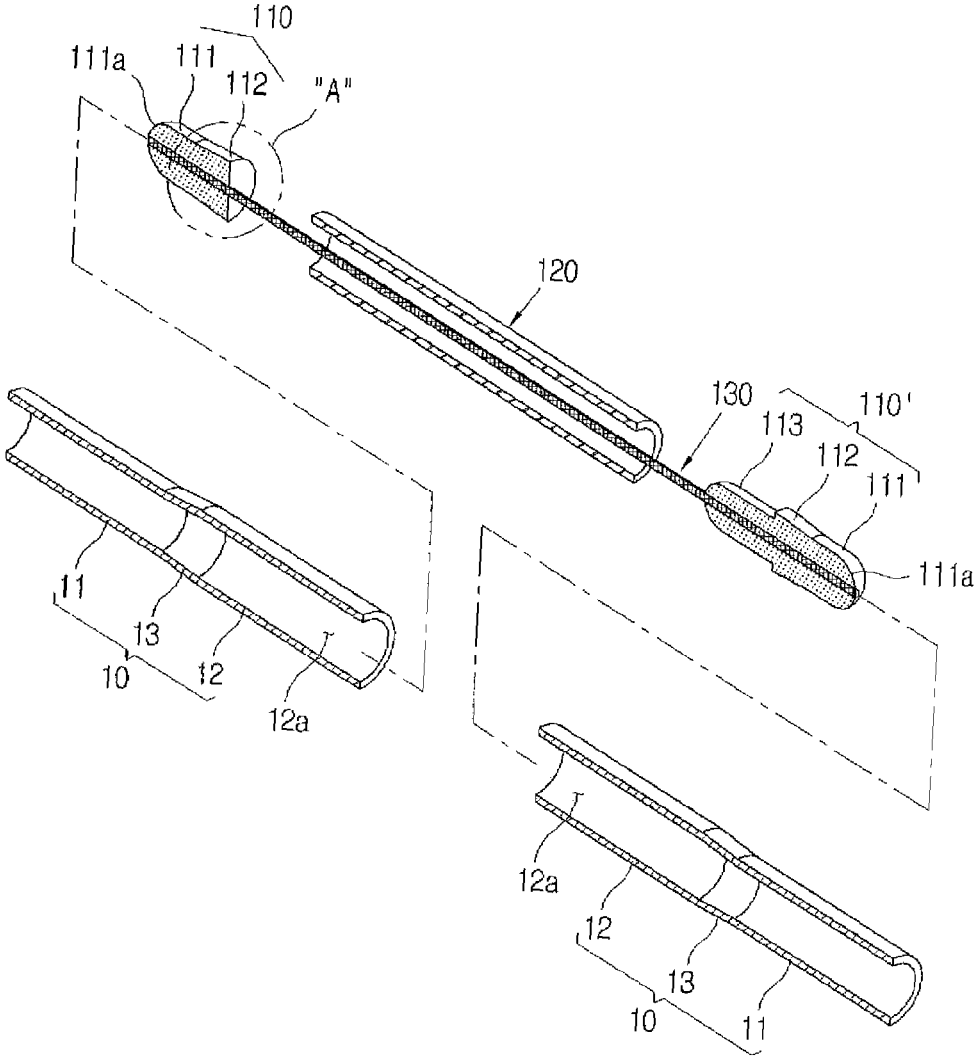
FIG. 2 is an exploded perspective view of a connection member for a tent pole according to an exemplary embodiment.
Figure 3:
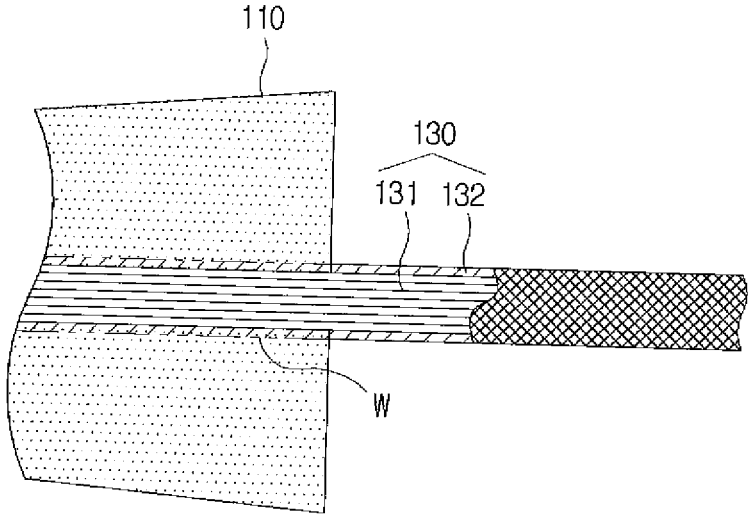
FIG. 3 is an enlarged cross-sectional view of an "A" part of FIG. 2.

Among the accompanying drawings, FIG. 1 is a perspective view of a connection member for a tent pole according to an exemplary embodiment, FIG. 2 is an exploded perspective view of a connection member for a tent pole according to an exemplary embodiment, and FIG. 3 is an enlarged cross-sectional view of an "A" part of FIG. 2.

As shown therein, the connection member for the tent pole according to an exemplary embodiment connects opposite adjacent unit poles 10, and includes a pair of insert members 110, 110' inserted in and fastened to an end part of the unit pole 10, a hollow connecting pipe body 120 arranged between the insert members 110 and 110' and having opposite end parts respectively inserted in the end parts of the unit pole 10 to thereby connect the opposite unit poles 10, and an elastic cord 130 having opposite end parts respectively coupled to the insert members 110 and 110' as it is inserted in the connecting pipe body 120.

The unit pole 10 includes a pole body 11, an expanded pipe part 12 having a larger diameter than the pole body 11 at the opposite end parts of the pole body 11, an inclined part 13 connecting the pole body 11 and the expanded pipe part 12, and an insertion hole 12*a* formed inside the expanded pipe part 12 and receiving the connecting pipe body 120.

The insert members 110 and 110' are respectively formed at the opposite end parts of the elastic cord 130 by insert injection-molding of a synthetic resin, and respectively fitted in the insertion holes 12*a* at the end parts of the adjacent opposite unit poles 10. Further, each of the insert members 110 and 110' includes an insertion part 111 inserted in the insertion hole 12*a* of the unit pole 10 and forcibly fitted in the pole body 11 at a front end part thereof, a tapered part 112 closely adhered to the inside of the inclined part 13 at a rear end part, and an inclined surface for guiding the insertion at a front end edge of the insertion unit 111. Also, one insert member 110' of the pair of insert members 110 and 110' is formed with a fixing part 113 inserted into one end part of the connecting pipe body 120 at the rear end part.

The connecting pipe body 120 is formed with a through hole in the middle thereof, is arranged between the insert members 110 and 110', and has the opposite end parts respectively inserted in the insertion hole 12*a* of the unit pole 10. The connecting pipe body 120 is equal to or shorter than total length of the insertion holes 12*a* of the opposite unit poles 10 so that the end parts of the unit poles 10 can contact each other in the state that the opposite end parts of the connecting pipe body 120 are inserted in the insertion hole 12*a* of the opposite unit pole 10 of which opposite end parts are adjacent to each other.

The elastic cord 130 has opposite end parts respectively coupled to the pair of insert members 110 and 110' in the state that the elastic cord 130 is inserted in a through hole of the connecting pipe body 120, so that the rear end parts of the insert members 110 and 110' can keep elastically contacting the opposite end parts of the connecting pipe body 120. The elastic cord 130 includes several rubber cords 131 having elasticity, and a braided layer 132 surrounding the outside of the rubber cords 131. The braided layer 132 is welded (W) to the inside of the insert members 110 and 110' during the injection molding process for the insert member 110 with a synthetic resin.

Now, operations of the foregoing connection member for the tent pole according to the first exemplary embodiment will be described.

Figure 4:
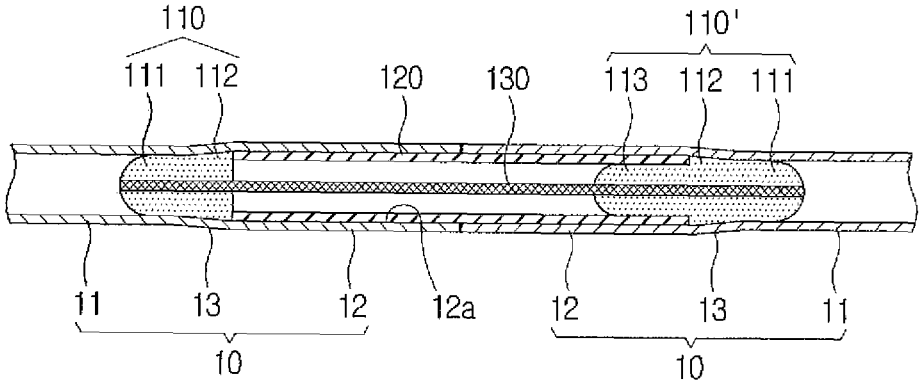
FIG. 4 is a cross-sectional view showing an assembled state of the connection member for the tent pole according to an exemplary embodiment.
Figure 5:
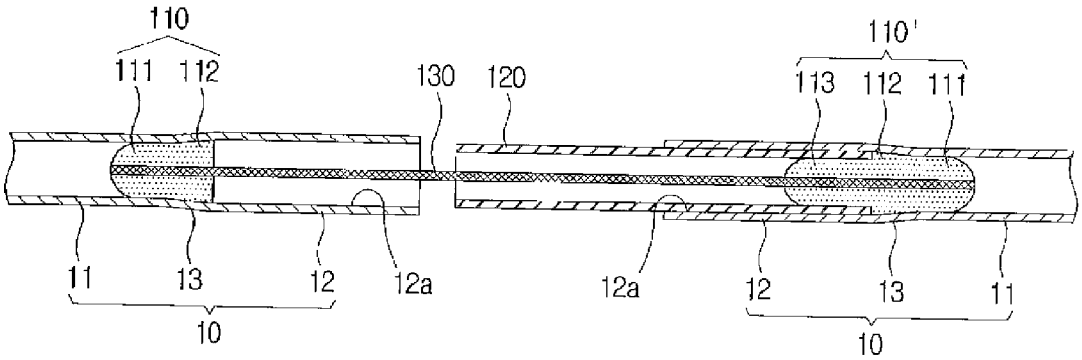
FIG. 5 is a cross-sectional view showing a disassembled state of the connection member for the tent pole according to an exemplary embodiment.
Figure 6:
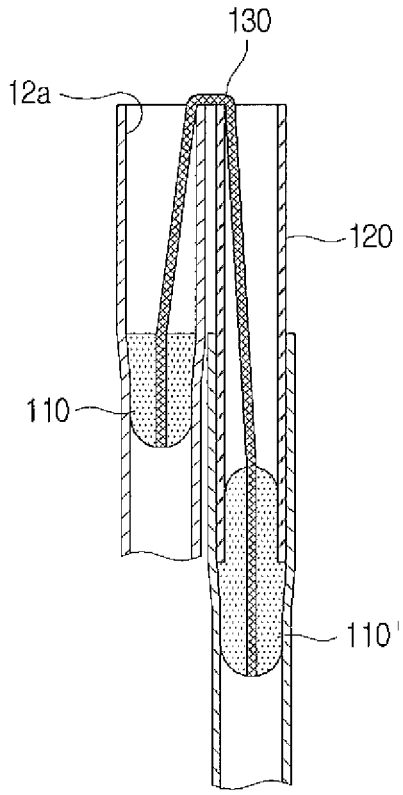
FIG. 6 is a cross-sectional view showing a folded state of the connection member for the tent pole according to an exemplary embodiment.

Accompanying drawings, FIG. 4 is a cross-sectional view showing an assembled state of the connection member for the tent pole according to an exemplary embodiment, FIG. 5 is a cross-sectional view showing a disassembled state of the connection member for the tent pole according to an exemplary embodiment, and FIG. 6 is a cross-sectional view showing a folded state of the connection member for the tent pole according to an exemplary embodiment.

FIG. 4 shows an assembled state where the opposite unit poles 10 are coupled by the connection member for the tent pole according to an exemplary embodiment. As shown therein, in the state that the elastic cord 130 is inserted in the connecting pipe body 120, the opposite end parts of the elastic cord 130 are respectively fixed to the insert members 110 and 110' arranged at opposite sides of the connecting pipe body 120.

At this time, the elastic cord 130 keeps elasticity enough to make the insert member 110 elastically adhered to the end part of the connecting pipe body 120, and is elastically extended if the insert member 110 is pulled outwardly.

Here, the insert members 110 and 110' are formed integrally with the elastic cord 130 by insert injection molding in the state that the elastic cord 130 is inserted therein. In this forming process, the braided layer 132 surrounding the outside of several rubber cords 131 is welded to the insert members 110 and 110' (see FIG. 3). Thus, it is possible to reduce work effort for fixing the elastic cord 130 to the insert members 110 and 110', and the insert members 110 and 110' can be formed by an automation process, thereby offering an advantage of reducing production costs. Further, the braided layer 132 is firmly welded to the inside of the insert members 110 and 110', so that the insert members 110 and 110' can be prevented from being freely separated from the elastic cord 130. Also, several rubber cords 131 constitute the elastic cord 130, thereby increasing durability thereof and prolonging the production life.

Meanwhile, one insert member 110' between the pair of insert members 110 and 110' is formed with the insertion part 111 inserted in and coupled to the connecting pipe body 120 at the rear end part thereof, and thus fastened to one end part of the connecting pipe body 120. Thus, the connecting pipe body 120 is prevented from being simultaneously separated from the opposite unit poles 10. Therefore, separation is possible by pulling out as much as the minimum length, and it is possible to prevent inconvenience that the connecting pipe body 120 is separated from both sides in assembling and disassembling processes.

As described above, in the state that the insert member 110' is fixed to one side of the connecting pipe body 120 and the insert member 110 connecting with the insert member 110' via the elastic cord 130 is in elastic contact with the other side of the connecting pipe body 120, if the opposite insert members 110 and 110' are respectively inserted into the insertion holes 12*a* formed at end parts of the unit poles 10, and then the insertion parts 111 of the insert members 110 and 110' are forcibly fitted in the pole bodies 11, the end part of the connecting pipe body 120 inserted in the insertion hole 12*a* is prevented from being caught in the inclined part 13 while the tapered part 112 at a rear end side finishes the inside of the inclined part 13 of the unit pole 10.

Meanwhile, the pair of insert members 110 and 110' respectively inserted in and fixed to the insertion holes 12*a* of the opposite unit poles 10 are connected by the elastic cord 130, so that the opposite insert members 110 and 110; can be pulled each other by the elasticity of the elastic cord 130. Therefore, in the state that the connecting pipe body 120 arranged between the opposite insert members 110 and 110' is inserted in each of the expanded pipe parts 12 of the opposite unit poles 10, the opposite unit poles 10 are kept as being connected.

Also, the connecting pipe body 120 is formed as a total length of the expanded pipe parts 12 of the opposite unit poles 10, and thus the end parts of the opposite unit poles 10 are in close contact with each other while the opposite unit poles 10 are being coupled to each other. Accordingly, in a process of setting up a tent, it is possible to prevent a pole insertion ring of the tent from being caught in a connection part of the unit poles 10 and disturbing the set-up of the tent. Further, a region between the pole body 11 and the expanded pipe part 12 different in a diameter is formed by the inclined part 13, thereby preventing the pole insertion ring of the tent from being interfered between the pole body 11 and the expanded pipe part 12.

FIG. 5 shows that the opposite unit poles 10 are separated from each other. As shown therein, if the opposite unit poles 10 are pulled in a separating direction, the connecting pipe body 120 of which the opposite end parts are being inserted in the insertion holes 12*a* of the unit poles 10 to connect the unit poles 10 is separated from the insertion holes 12*a* so that the opposite unit poles 10 are separated from each other.

At this time, since the insertion part 111 formed at the rear end part of one insert member 110' is inserted in and fixed to the connecting pipe body 1 in the state that the connecting pipe body 120 is arranged between the insert members 110 and 110', one end part of the connecting pipe body 120 is inserted in the insertion hole 12*a* of the one side unit pole 10 and at the same time the other end part is separated from the insertion hole 12*a* of the other side unit pole 10. In this process, the elastic cord 130 connecting both insert members 110 and 110' are elastically extended.

As above, in the state that the opposite unit poles 10 are separated from each other, the unit poles 10 can be folded for storage as shown in FIG. 6. Also, if the unit poles 10 are opened, the extended elastic cord 130 is contracted and thus the end part of the connecting pipe body 120 separated from the unit pole 10 is inserted in the insertion hole 12*a* of the unit pole 10, thereby automatically coupling the opposite unit poles 10.

Hence, as described above, the connection member for the tent pole according to the exemplary embodiment enables the plurality of poles to be connected by assembling the connection members in the connection part of the poles, thereby offering an advantage that assembling efforts are simplified as compared with a conventional method where one rubber cord passes through the inside of the plurality of poles in order to connect the plurality of poles.

Also, if a rubber cord is broken at a part where the poles are connected, the connection member at the corresponding part has only to be replaced, thereby solving problems that all the plurality of poles constituting one set has to be taken for repairing or a new set of poles connected by the rubber cord has to be purchased again.

Figure 7:
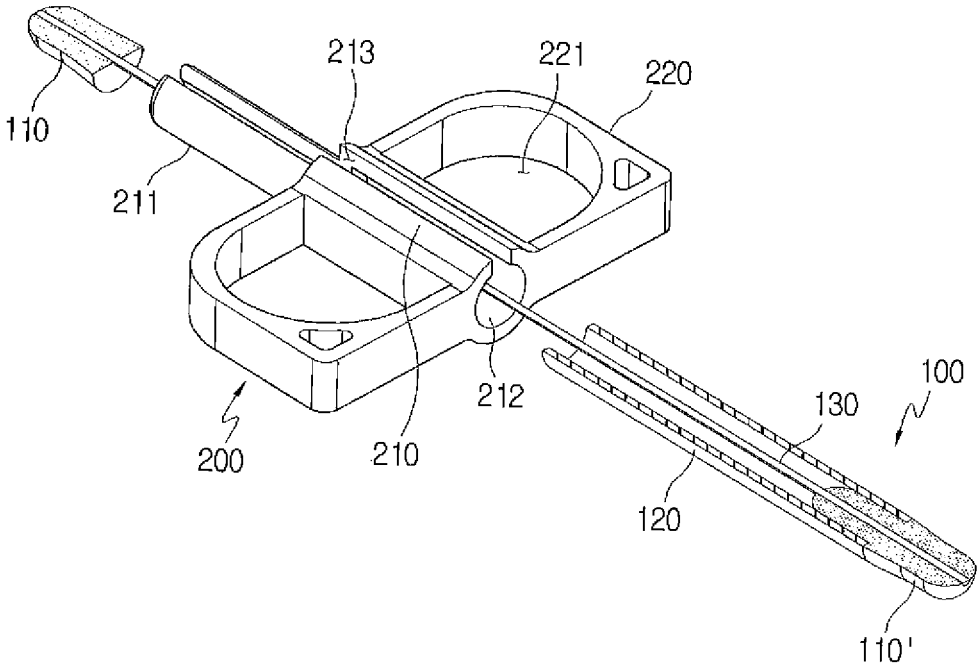
FIG. 7 is a perspective view of a detachable jig for the connection member according to an exemplary embodiment.
Figure 8:
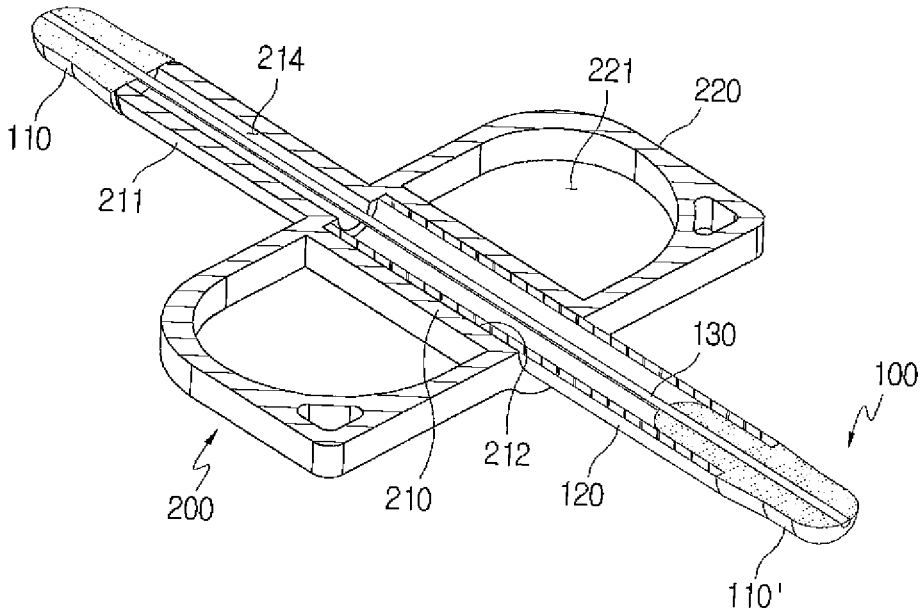
FIG. 8 is a partial cut-open perspective view of the detachable jig for the connection member according to an exemplary embodiment.

Next, a detachable jig for the connection member according to an exemplary embodiment will be described. Among the accompanying drawings, FIG. 7 is a perspective view of a detachable jig for the connection member according to an exemplary embodiment, and FIG. 8 is a partial cut-open perspective view of the detachable jig for the connection member according to an exemplary embodiment.

As shown therein, the jig 200 for the connection member is to fix or separate the insert members 110 and 110' of the connection member 100 to the inside of the unit pole 10, which includes a body 210 having one end part formed with an insertion pin 211 to be inserted in the insertion hole 12*a* of one side unit pole 10 and the other end part formed with a receiving groove 212 in which the connecting pipe body 120 coupled to the other side unit pole 10 is inserted; a through hole 214 formed by penetrating the inside of the body 210 so that the elastic cord 130 connecting the opposite insert members 110 and 110' can be inserted in the body 210; a cut-opened part 213 formed lengthwise on an outer side of the body 210 and opening one side of the through hole 214 and the receiving groove 212; and a grip 220 formed at opposite sides of the body 210 and formed with a finger hole 221 through which a user can easily grip the body 210.

Here, the length of the insertion pin 211 of the body 210 and the depth of the receiving groove 212 are half of total length of the connecting pipe body 120, so that the insert members 110 and 110' respectively inserted in the opposite unit poles 10 can be fitted and fixed at the same pressure and depth.

Among the accompanying drawings, FIGS. 9 to 12 are cross-sectional views showing use of the detachable jig for the connection member according to an exemplary embodiment.

Figure 9:
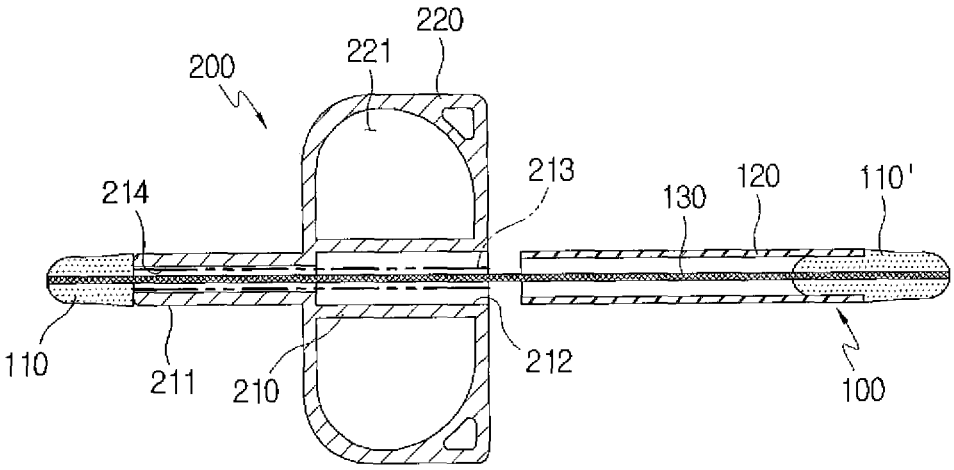
FIGS. 9 to 12 are cross-sectional views showing use of the detachable jig for the connection member according to an exemplary embodiment.

First, as shown in FIG. 9, the insert member 110 not fixed to the connecting pipe body 120 is pulled from the end part of the connecting pipe body 120 so as to sufficiently extend the elastic cord 130. Then, if the elastic cord 130 is inserted in the through hole 214 and the receiving groove 212 of the body 210 via the cut-opened part 213 formed lengthwise on the outer side of the body 210, and the force of pulling the insert member 110 is released, the rear end part of the insert member 110 keeps elastically close contact with the front end part of the insertion pin 211

Figure 10:
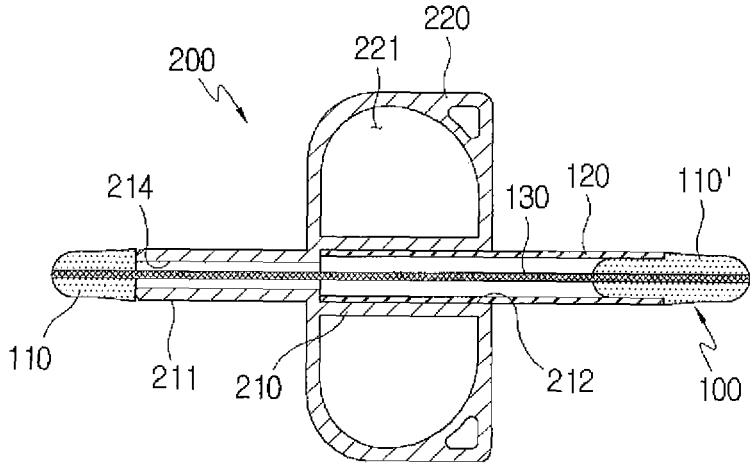

Then, as shown in FIG. 10, if the force of pulling the connecting pipe body 120 is released, the connecting pipe body 120 fixed to the insert member 110 is inserted in the receiving groove 212 of the body 210 while the other side insert member 110' connecting with the insert member 110 through the elastic cord 130 is drawn toward the body 210 by the elasticity of the elastic cord 130.

Figure 11:
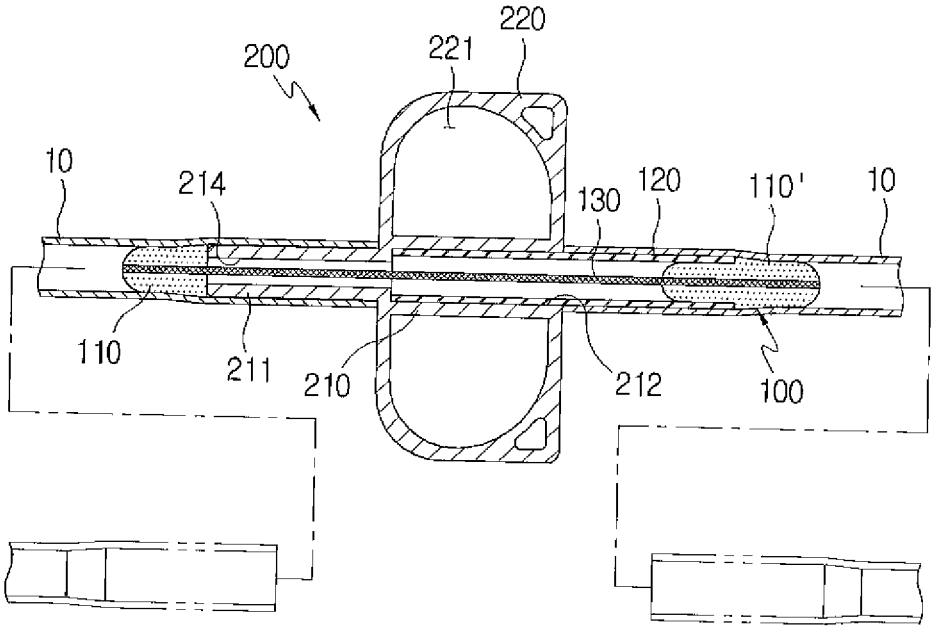

As described above, in the state that the connection member 100 is coupled to the jib 200 in this exemplary embodiment, as shown in FIG. 11, if the body 210 is gripped by inserting a middle finger and an index finger in the finger hole 221 of the grip 220 and then the insertion pin 211 of the body 210 is pushed in the insertion hole 12*a* of the one side unit pole 10, the one side unit pole 110 is inserted in the unit pole 10 as much as the length of the insertion pin 211 and thus fitted in the inside of the pole body 11.

Also, if an assembling direction is changed by the middle finger and the index finger inserted in the finger hole 221 of the grip 220 and then the other exposed end part of the connecting pipe body 120 having one end inserted in the receiving groove 212 of the body 210 is pushed in a receiving hole of the other side unit pole 10, the other side insert member 110' is fitted in and fixed to the inside of the pole body 11 while being inserted in the unit pole 10 as much as the length of the exposed connecting pipe body 120.

Here, the length of the insertion pin 211 is half of the total length of the connecting pipe body 120, and the depth of the receiving groove 212 is half of the total length of the connecting pipe body 120, so that the opposite insert members 110 and 110' can be inserted in and fitted in the unit pole 10 as deep as half of the depth of each connecting pipe body 120, thereby having a uniform fixing force.

Figure 12:
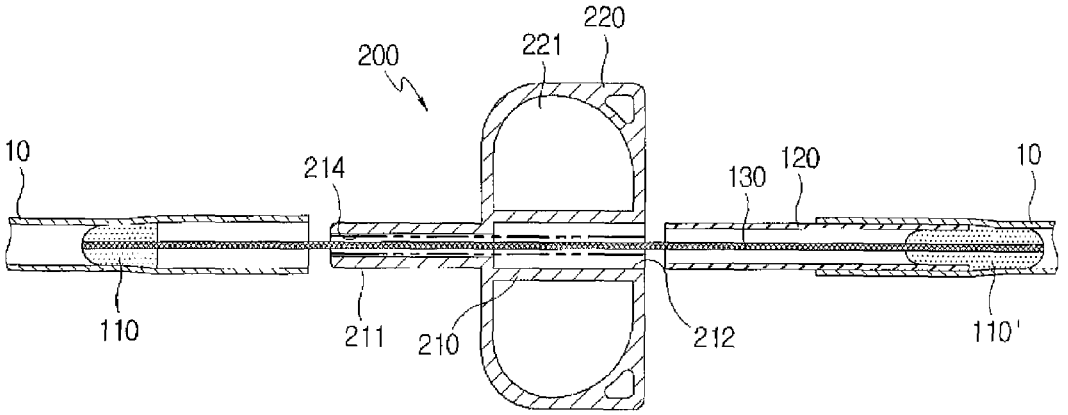

As above, if the insert members 110 and 110' are respectively fitted in and fixed to the opposite unit poles 10, the opposite unit poles 10 are pulled in the separating direction as shown in FIG. 12 so as to separate the one side unit pole 10 from the insertion pin 211 of the body 210 and separate the connecting pipe body 120 coupled to the other side unit pole 10 from the receiving groove 212 of the body 210. Then, the elastic cord 130 connecting the pair of insert members 110 and 110' and passing through the through hole 214 and the receiving groove 212 of the body 210 is drawn through the cut-opened part 213 formed lengthwise on the outer side of the body 210, thereby separating the body 210 from the elastic body 130.

If the jig 200 is used to forcibly fit the insert members 110 and 110' in the unit pole 10 through, the insert members 110 and 110' are forcibly fitted in the insides of the opposite unit poles 10 at the same depth and pressure, so that the insert members 110 and 110' forcibly fitted in the unit poles 10 in order to connect the opposite unit poles 10 while separating the unit poles 10 can be prevented from being easily separated due to imbalance of the coupling force.

Figure 13:
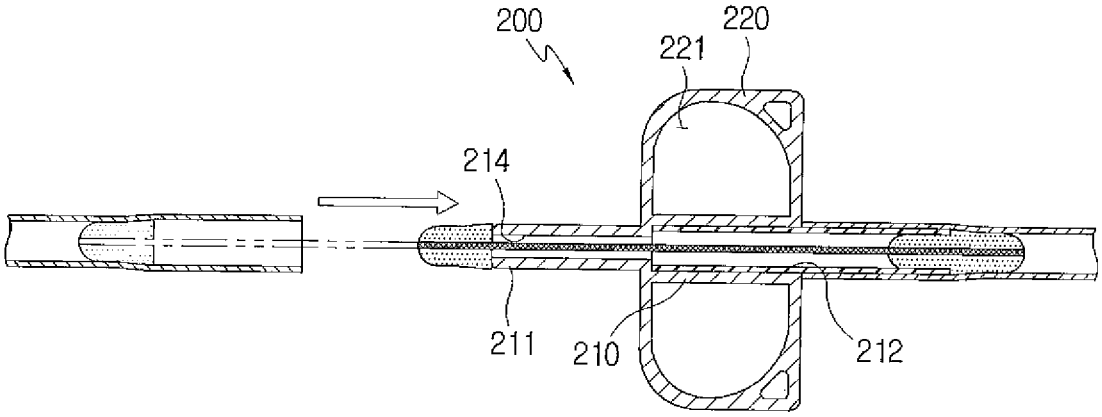
FIGS. 13 and 14 are cross-sectional views showing that an insert member is separated from the unit pole through the detachable jig for the connection member according to an exemplary embodiment.
Figure 14:
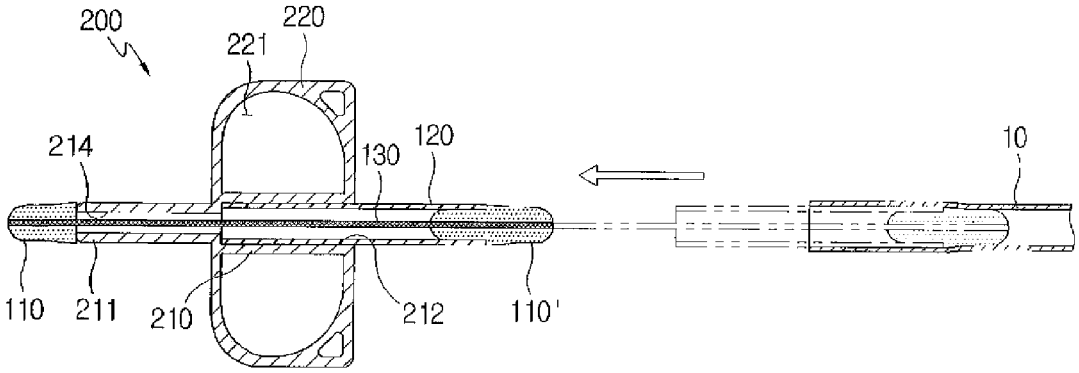

Among the accompanying drawings, FIGS. 13 and 14 are cross-sectional views showing that an insert member is separated from the unit pole through the detachable jig for the connection member according to an exemplary embodiment.

First, to separate the insert members 110 and 110' forcibly fitted in the unit pole 10, in reverse order of separating the jig 200, the elastic cord 130 is inserted in the through hole 214 and the receiving groove 212 through the cut-opened part 213 of the body 210 (see FIG. 12) in the state that the opposite unit poles 10 are pulled at opposite directions and the elastic cord 130 is thus extended. Then, as shown in FIG. 13, in the state that the one side unit pole 10 is gripped by one hand, and the grip 220 of the jig 200 is gripped by the other hand, if the jig 200 is pulled in the arrow direction, the elastic cord 130 is extended and then the insert member 110 is separated from the unit pole 10 at the moment when a force greater than the coupling force of the insert member 110 acts.

Then, as shown in FIG. 14, in the state that the other side unit pole 10 is gripped by one hand and the grip 220 of the jig 200 is gripped by the other hand, if the jig 200 is pulled in the arrow direction, the elastic cord 130 is extended and then the insert member 110' is separated from the unit pole 10 at the moment when a force greater than the coupling force of the insert member 110'. Along with the separation of the insert member 110', the connecting pipe body 120 fixed to the insert member 110' is inserted in the receiving groove 212 of the body 210 by the elastic restoring force of the elastic cord 130.

As above, in the process of separating the insert members 110 and 110' from the unit pole 10, the jig is pulled by a force greater than the coupling force of the insert members 110 and 110'. In this process, a user's finger is located in the finger hole 221 formed inside the grip 220, so that contact with a user's body is prevented when the insert member 110 separated from the unit pole 10 or the connecting pipe body 120 fixed to the insert member 110' are strongly drawn by the elastic restoring force of the elastic cord 130.

Accordingly, there are provided a connection member for a tent pole, which is lightweight since the minimum length of an elastic cord is applied to only end parts of unit poles so as to connect the unit poles, and a detachable jig for the same, in which the connection members for the tent pole can be conveniently and precisely assembled and disassembled.

As described above, there is provided a connection member for a tent pole, which is lightweight since the minimum length of an elastic cord is applied to only end parts of unit poles so as to connect the unit poles.

Also, there is provided a connection member for a tent pole, in which if a rubber cord is broken due to repeated use, only the connection member of a corresponding position can be replaced with a new connection member, and thus there is no problem of long repairing time or no exorbitant cost of repair as opposed to a conventional one.

Further, there is provided a connection member for a tent pole, in which a rubber cord connecting two poles is independently arranged in a part where the poles are folded, so that the rubber cord can be tensed having constant elasticity regardless of folding positions, thereby preventing the life of the rubber cord from being shortened as it is excessively tensed at only a certain region like the conventional one.

Further, there is provided a connection member for a tent pole, in which a pair of inserts to which both end parts of a rubber cord are fastened to end parts of a pair of unit poles, so that an assembling process can be simplified without passing the rubber cord through the inside of the unit poles like the conventional one.

Further, there is provided a connection member for a tent pole, in which both end parts of an elastic cord are formed integrally with insert members through insert injection molding, thereby decreasing manufacturing and assembling efforts and enabling production automation.

Further, there is provided a connection member for a tent pole, in which an elastic cord is configured with several rubber cords surrounded by a braided layer, and the braided layer is welded to an insert member while the insert member is molded, thereby preventing the insert member from being separated from the elastic cord.

Further, there is provided a detachable jig of a connection member for a tent pole, in which a pair of insert members are forcibly fitted in opposite unit poles at the same depth and by the same pressure while the insert members of the connection member for the tent pole are forcibly fitted in the opposite unit poles, so that either of the insert members can be prevented from being easily separated due to imbalance of coupling force while disassembling the unit poles.

Further, there is provided a detachable jig of a connection member for a tent pole, in which opposite sides of a body are formed with grips having finger holes, so that a user can be protected from being hit by the insert member while pulling out the insert member from the unit pole.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A tent pole comprising:

a pair of unit tent poles of which opposite end parts are internally formed with insertion holes;

a connection member comprising a pair of insert members which are respectively fitted in and fixed to insertion holes at end parts of the pair of unit poles, wherein the unit poles are adjacent each other;

a connecting pipe body which is formed with a through hole in a middle thereof to be arranged between the pair of insert members and comprises opposite end parts respectively inserted in the insertion holes of the pair of unit poles; and an elastic cord which comprises opposite end parts respectively fixed to the pair of insert members, is inserted in the through hole of the connecting pipe body, and provides elasticity so that the end parts of the pair of adjacent unit poles can be in contact with each other, wherein the opposite end parts of the elastic cord are integrated with an inside of the insert member and the elastic cord comprises a plurality of rubber cords having elasticity, and a braided layer surrounding the outside of the rubber cords, and the braided layer is welded to the inside of the insert members, and wherein the pair of unit poles each comprise an expanded pipe part to receive the connecting pipe body at opposite end parts of a pole body, and an inclined part at an edge between the pole body and the expanded pipe part, and each insert member comprises an insertion part at a front end part being fitted in the insertion hole of the unit pole, and a tapered part at a rear end part being closely adhered to an inside of the inclined part.

2. The tent pole according to claim 1, wherein the insert member is formed with a curved surface for guiding insertion at a front end edge of the insertion part.

3. The tent pole according to claim 1, wherein one of the pair of insert members is formed with a fixing part at the rear end part to be inserted in the connecting pipe body, and fixed to the connecting pipe body.

4. A detachable jig of assembling the connection member to the pair of unit tent poles according to claim 1, the detachable jig comprising:

a body formed with an insertion pin at one end part thereof to be inserted in the insertion hole of one of the unit poles for pushing the insert ember into and fitted to the insertion hole, and a receiving groove to receive the connecting pipe body at the other end part thereof;

a through hole connecting the insertion pin and the receiving groove of the body; and a cut-opened part lengthwise formed at one side of the body and laterally opening the through hole and the receiving groove for receiving and removing the elastic cord of the connecting member.

5. The detachable jig according to claim 4, wherein the length of the insertion pin and the depth of the receiving groove are respectively half of total length of the connecting pipe body.

6. The detachable jig according to claim 5, wherein the body comprises a grip at least one side thereof.

7. The detachable jig according to claim 6, wherein the grip internally comprises a finger hole.

8. A detachable jig of assembling the connection member according to claim 2 to the tent pole, the detachable jig comprising:

a body formed with an insertion pin at one end part of the body to be inserted in the insertion hole of one of the unit poles for pushing the insert member into and fitted to the insertion hole, and a receiving groove to receive the connecting pipe body at the other end part of the body thereof;

a through hole connecting the insertion pin and the receiving groove of the body; and a cut-opened part lengthwise formed at one side of the body and laterally opening the through hole and the receiving groove for receiving and removing the elastic cord of the connecting member.

9. The detachable jig according to claim 8, wherein the length of the insertion pin and the depth of the receiving groove are respectively half of total length of the connecting pipe body.

10. The detachable jig according to claim 9, wherein the body comprises a grip at least one side thereof.

11. The detachable jig according to claim 10, wherein the grip internally comprises a finger hole.

12. A detachable jig of assembling the connection member according to claim 3 to the tent pole, the detachable jig comprising:

a body formed with an insertion pin at one end part of the body to be inserted in the insertion hole of one of the unit poles for pushing the insert member into and fitted to the insertion hole, and a receiving groove to receive the connecting pipe body at the other end part of the body;

a through hole connecting the insertion pin and the receiving groove of the body; and a cut-opened part lengthwise formed at one side of the body and laterally opening the through hole and the receiving groove for receiving and removing the elastic cord of the connecting member.

13. The detachable jig according to claim 12, wherein the length of the insertion pin and the depth of the receiving groove are respectively half of total length of the connecting pipe body.

14. The detachable jig according to claim 13, wherein the body comprises a grip at least one side thereof.

15. The detachable jig according to claim 14, wherein the grip internally comprises a finger hole.

* * * * *

UNITED STATES PATENT AND TRADEMARK OFFICE

CERTIFICATE OF CORRECTION

PATENT NO. : 8,813,768 B2
APPLICATION NO. : 13/266302
DATED : August 26, 2014
INVENTOR(S) : Yoon Bok Lee It is certified that error appears in the above-identified patent and that said Letters Patent is hereby corrected as shown below:

In the Claims,

Claim 4 (Column 10, Line 28)

"...for pushing the insert ember into and fitted to the inser-..." should read --...for pushing the insert member into and fitted to the inser-...--

Signed and Sealed this
Twenty-third Day of December, 2014

Michelle K. Lee

Michelle K. Lee
*Deputy Director of the United States Patent and Trademark Office*